US006974045B1

(12) United States Patent
Trombach et al.

(10) Patent No.: US 6,974,045 B1
(45) Date of Patent: Dec. 13, 2005

(54) SEALING DISC AND FILM COMPOSITE FOR A CLOSURE OF A CONTAINER

(75) Inventors: Horst Trombach, Bremen (DE); Heinz-Rudolf Wiening, Alfeld (DE)

(73) Assignee: Alfelder Kunststoffwerke Herm. Meyer GmbH, (DE)

( * ) Notice: Subject to any disclaimer, the term of this patent is extended or adjusted under 35 U.S.C. 154(b) by 0 days.

(21) Appl. No.: 10/009,429

(22) PCT Filed: May 3, 2000

(86) PCT No.: PCT/EP00/03955

§ 371 (c)(1),
(2), (4) Date: May 22, 2002

(87) PCT Pub. No.: WO00/66453

PCT Pub. Date: Nov. 9, 2000

(30) Foreign Application Priority Data

May 4, 1999 (DE) ..... 199 20 586

(51) Int. Cl.[7] ..... B65D 41/04; B65D 51/20; B65D 53/04

(52) U.S. Cl. ..... 215/232; 215/305; 215/347; 215/349; 220/258.2; 220/359.2; 220/359.3

(58) Field of Search ..... 215/232, 346, 215/347, 349, 350, 305, 258; 220/359.2, 220/359.3, 359.4, 359.1, 258.1–258.2, 258.3

(56) References Cited

U.S. PATENT DOCUMENTS

| | | | | |
|---|---|---|---|---|
| 2,937,481 A | | 5/1960 | Palmer | |
| 3,690,909 A | | 9/1972 | Finley | |
| 3,767,076 A | | 10/1973 | Kennedy | |
| 3,815,314 A | | 6/1974 | Pollock et al. | |
| 4,017,704 A | | 4/1977 | Collins, III et al. | |
| 4,044,941 A | | 8/1977 | Knudsen | |
| 4,579,240 A | | 4/1986 | Ou-Yang | |
| 4,588,099 A | * | 5/1986 | Diez | 215/232 |
| 4,588,465 A | | 5/1986 | Paciorek | |
| 4,595,434 A | | 6/1986 | Eckstein et al. | |
| 4,596,338 A | | 6/1986 | Yousif | |
| 4,724,026 A | | 2/1988 | Nelson | |
| 4,754,890 A | * | 7/1988 | Ullman et al. | 215/232 |
| 4,771,903 A | | 9/1988 | Levene et al. | |
| 4,917,949 A | | 4/1990 | Yousif | |
| 4,934,544 A | | 6/1990 | Han et al. | |
| 4,960,216 A | * | 10/1990 | Giles | 215/232 |
| 5,004,111 A | * | 4/1991 | McCarthy | 215/232 |
| 5,149,386 A | | 9/1992 | Smits et al. | |
| 5,265,745 A | * | 11/1993 | Pereyra et al. | 215/232 |
| 5,381,913 A | | 1/1995 | Peeters | |
| 5,433,992 A | * | 7/1995 | Galda et al. | 428/201 |
| 5,514,442 A | * | 5/1996 | Galda et al. | 428/78 |
| 5,560,989 A | | 10/1996 | Han | |
| 5,669,521 A | | 9/1997 | Wiening et al. | |

(Continued)

FOREIGN PATENT DOCUMENTS

DE 32 24 342 A1 1/1984

(Continued)

*Primary Examiner*—Nathan J. Newhouse
*Assistant Examiner*—Niki M. Eloshway
(74) *Attorney, Agent, or Firm*—Slater & Michaelson

(57) ABSTRACT

A sealing disc and a film composite for a container closure is provided, for use on a container with an opening bounded by a peripheral edge. The film composite includes a plurality of layers. An adhesive layer is arranged at least over a joining surface between the upper layer and the underlying layer.

15 Claims, 1 Drawing Sheet

U.S. PATENT DOCUMENTS

| | | | | | |
|---|---|---|---|---|---|
| 5,702,015 | A | * | 12/1997 | Giles et al. | 215/232 |
| 5,915,577 | A | * | 6/1999 | Levine | 215/232 |
| 6,082,566 | A | * | 7/2000 | Yousif et al. | 215/232 |
| 6,082,568 | A | * | 7/2000 | Flanagan | 215/257 |
| 6,104,013 | A | | 8/2000 | Miller | |

FOREIGN PATENT DOCUMENTS

| | | | |
|---|---|---|---|
| DE | 39 20 324 | A1 | 6/1989 |
| DE | 94 10 934.6 | U1 | 7/1994 |
| EP | 0 408 217 | A | 1/1991 |
| EP | 0 395 660 | B1 | 10/1991 |
| EP | 0 534 949 | B1 | 10/1995 |
| EP | 0 697 345 | A2 | 2/1996 |
| EP | 0 717 710 | B1 | 4/1999 |
| FR | 2 463 468 | A | 2/1981 |

* cited by examiner

SEALING DISC AND FILM COMPOSITE FOR A CLOSURE OF A CONTAINER

BACKGROUND 1.0 Field of the Disclosure

The present disclosure is directed to a cap for a container closure and, in particular, to a cap with a sealing disc.

2.0 Related Art

On the closure of a container it is frequently desirable, or even necessary, to provide the container mouth with a disc-shaped closure which seals off the contents, for example, liquids or else substances such as foodstuffs.

There are several reasons why the sealing off is required. On the one hand, the contents are to be protected against outside influences, for example, against water vapor or oxygen. On the other they are also to remain aroma-tight. There is a further reason in the case of aggressive contents, for which leakage protection must be optimized. Finally, an originality protection for the trade also may be provided by such a sealing off, because a user is able to recognize immediately whether someone has already handled the container contents beforehand.

In addition, the container closure is then also sealed with a screw cap or a similar element, which ensures a mechanical and stable sealing outside the film. On initial use the user destroys the film in order to obtain access to the contents of the container. The user may then close the container afterwards (unless he has already removed the entire contents) with the screw closure, which may provide a temporary seal for the opened contents for a suitably short period of time.

The film that seals the container contents is frequently applied by induction sealing. A complete sealing disc is put on for this purpose, having a bottom layer that forms the sealing layer. Above the sealing layer lies a second layer, generally aluminum, which serves for the generation and transmission of heat during the induction process and optionally forms an additional mechanical protection. The second layer is firmly connected to the first layer and in particular favorably for the transmission of heat. Above the second, aluminum layer are further components of the sealing disc, which remain in the cap after opening the screw or other rotating closure.

The removal of the film is irksome for the user in certain circumstances, which may require a tool, for example, a knife or a pair of scissors. Use of a tool leads to the risk that parts of the film will thereby fall into the container contents. In addition, a suitable tool is not always at hand. Screw closures already exist with an outside so formed that when used the other way round they permit a partial cutting or tearing of the film here. This makes the screw cap more expensive, and it is also necessary to give the user suitable instructions on the method, so that he may carry out the opening correctly.

It has also already been proposed as an alternative, for example in EP 0 697 345 A2, that the sealing disc, or at least the film composite, be provided at its edge with suitable projections or tabs, which the user may grasp, thus allowing the user, supported in this way, to easily remove the sealed-on film. The extremely practical construction may not be used in every case, however, because the projecting tabs must, after the positioning of the screw cap, be able to be arranged between the screw thread and the outside of the container opening, a fact which may lead to geometrical difficulties. It is also problematical if, for example, the upper parts of the sealing disc must not exhibit any lugs, because this prevents their retention in the screw cap part. Two separate punching operations would then have to be provided for the film composite and the upper parts of the sealing disc, which leads to further costs.

It has therefore been proposed in EP 0 395 660 B1 and EP 0 534 949 B1 that the sealed-on film composite be constructed of two layers that are bonded to one another over roughly half of their area, while the other half remains free. This results in easy detachment of the half of the upper layer that is not bonded, whereas the other area remains connected during the detachment. If such a two-layered, partially bonded film composite is used on the container, the user simply has to grasp the admittedly flatly positioned but easily detachable half of the upper layer, and is then able to remove the whole of the film composite by exerting a suitable force.

This rather striking idea nevertheless has some drawbacks. A mass market product is naturally involved, in which cost considerations play a very great role. A process must therefore be found in which two layers may be connected to one another in such a way that they are only partially bonded. This can be brought about by a relatively laborious strip-wise lamination.

A further drawback is due to the partially open upper layer, which causes problems during the filling and closing of the containers. If the screw closure is applied with rotation, the latter has a tendency to attack the film by friction. As the upper layer is supported loosely in part, it is on some occasions also pulled slightly here, which may lead immediately to uncontrolled creasing and also to buckling and to destruction. In the container filling industry, however, even minimal wastage rates are extremely undesirable because, as a rule, the whole container then has to be rejected or may lead to complaints.

The object of the present disclosure is therefore a sealing disc and a sealing film for a container closure which also leads to an easy opening of the film for the user, but at the same time is also convenient and reliable in manufacture and does not require additional punching operations.

SUMMARY

The object is achieved in the case of a film composite by the fact that the upper-most of the layers of the film composite includes an upwardly projecting fold.

There may be exploited first of all with such a fold all the advantages that are also exhibited by ideas, for example, from EP 0 395 660 B1 or EP 0 534 494 B1. It is not necessary to cut open the film composite or to provide tabs projecting over the edge. In the case of a positioned screw cap, the fold naturally lies flat on the top side of the remaining film composite. The fold is not bonded with the latter, however, because the outside of the upper layer is here supported on another area of the outside of the upper layer.

The user may simply grasp the fold, raise it and then remove the entire film composite along with the fold. In so doing, the user will grip one end of the fold and be able to pull the film easily upward vertically, whereby a "rolling away" of the remaining edge is then obtained.

Conversely, the drawbacks from the aforementioned prior art are advantageously not encountered. The outer edge of the film composite includes, in fact, the same, identical formation the whole way round: both the upper and the lower layers are present everywhere. Thus, there is therefore no tendency to buckling or creasing.

The flatly positioned fold represents, in contrast to the prior art, additional material and is therefore relatively insensitive. Without an additional punching operation it does not project, even in the flat lying state, completely up to the edge side, but ends before the latter.

Particularly preferably, the fold is so arranged that it lies off-center. As a result, it will have a tendency to tilt in one direction, without its raising being affected disadvantageously in any way.

In order to simplify the gripping area and the tearing open, the fold should however remain relatively adjacent to the center, so that a division of the overall surface is preferred such that the smaller area occupies a zone of 40% to below 50% of the total area.

It has proved to be particularly practical for grasping if the fold exhibits a spacing of between 0.5 and 2 cm, in particular between 1 and 1.5 cm, between the fold bottom directly on the sealing film and the fold tip.

It is also preferable if the adhesive layer is provided at any rate in the area of the upper layer that forms the fold. In this way there will be formed in the zone a contacting of adhesive layer to adhesive layer within the fold, which increases and improves the stability and firm bonding of the latter enormously. This has a corresponding effect on the tearing and tensile strength and also prevents the fold from bulging or swelling in a roughly oval shape due to external effects.

It is particularly preferable, finally, if the adhesive layer occupies the whole area of the upper layer. This is of advantage in production engineering terms; the stripwise lamination known from the prior art, with partial provision and partial omission of an adhesive layer, is especially complicated, in fact, and the full area bonding furthermore also improves the stability and the adhesion of the entire film composite.

Furthermore, it is advantageous if the whole area of the sealing film is slightly greater than the opening to be covered, including the peripheral edge.

This very slightly projecting amount of material makes it easier to pull the edge upwardly when grasping the fold. A quite small edge area is created, in fact, which is not be grasped from behind, but which during the raising of the fold is on the peripheral edge of the opening of the container without direct adhesion, and thus favorably influences the tearing process. The projecting edge is on the other hand of such small proportions that it is significantly smaller than, for example, the tabs from EP 0 697 345 A2, and in no circumstances comes into contact with the screw cap.

The foregoing object is achieved in the case of a sealing disc by the fact that the lower layers of the sealing disc include the film composite according to one of the above combinations of features.

Such a sealing disc possesses all the above-mentioned advantages. It is perfectly possible to incorporate the layer forming the fold, together with the fold, immediately in the production of the sealing disc, and then to use the complete component in this way in the packaging industry.

BRIEF DESCRIPTION OF THE DRAWINGS

An embodiment of the disclosure will be described in detail below with reference to the drawings, in which.

DETAILED DESCRIPTION OF THE PREFERRED EMBODIMENTS

A container 10 is filled, for example, with foodstuffs or agrochemicals or other oxygen-sensitive goods, in particular with liquid. Container 10 includes an opening 11 from which the contents are to be removed at a given time. The opening 11 is surrounded by a peripheral edge 12.

Opening 11 is sealed by a film composite 30. Above film composite 30 is also located a screw cap (not shown), with which, even if film composite 30 is destroyed, the container may be sealed at least temporarily. The screw cap also serves to protect film composite 30 against mechanical influences from outside.

Figure 2:
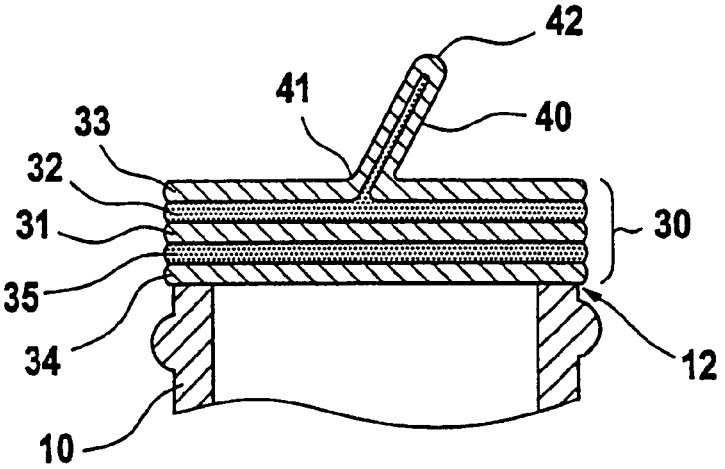
FIG. 2 is a diagrammatic section through the sealing film from FIG. 1.

Film composite 30 includes in particular three film layers and two adhesive layers, as shown in FIG. 2. A first or bottom-most layer 34 is in the sealed-on state fixed exactly on the peripheral edge 12 of the container 10. On first layer 34 is arranged an adhesive layer 35, which connects first layer 34 firmly to a second layer 31. Second layer 31 is an induction film, in particular of aluminum. If second layer 31 is heated by induction, the heat is transferred to first layer 34, thus sealing layer 34 firmly on edge 12.

A further adhesive layer 32 is provided on the second layer 31, which is the induction film. Second adhesive layer 32 continuously connects layer 31 to upper-most layer 33.

Layer 33 includes a fold 40. Layer 33 is planar outside the area of fold 40 and is connected to underlying layer 31 continuously by the adhesive layer 32. In the area of fold 40, the whole of layer 33 is laid double starting from fold bottom 41 and extends like this up to fold tip 42, and from there back again to fold bottom 41. Between the two doubly laid material components of upper layer 33 is also located adhesive layer 32, and preferably likewise two-fold. This can be brought about at the manufacturing stage by upper layer 33 being coated with adhesive layer 32 over its whole surface while still in the unfolded state, and then during the line manufacture being bent onto layer 31 of the induction film with the addition of the fold. Thus, fold 40 is particularly stable, and because of the dual adhesion, also bonded particularly firmly into itself. It may nevertheless have a light and filigree effect, for example, because of the fact that the whole of layer 33 is made of a transparent material.

Fold 40 extends diagonally across the film at right angles to the drawing plane. The distance between fold bottom 41 and fold tip 42 is constant here, optionally with bevels or curves in the edge area. The fold tip therefore forms a substantially straight line.

Figure 1:
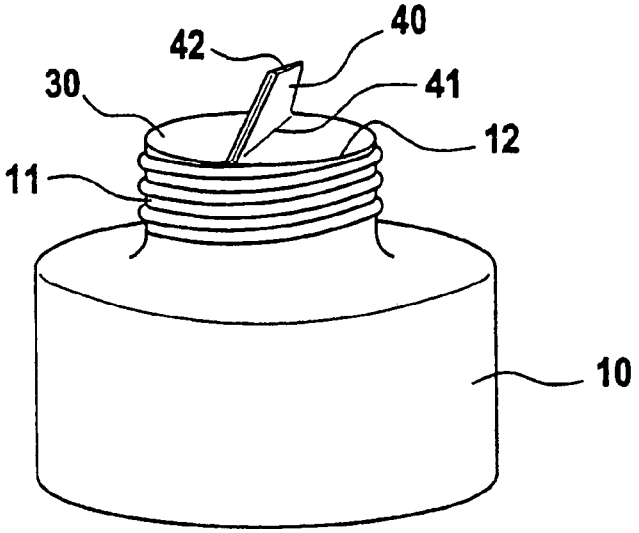
FIG. 1 shows a diagrammatic perspective view of a container with a first form of execution of the sealing film.

The effect that the whole of this has can be seen in FIG. 1. The whole of the container mouth or opening 11 of container 10, which mouth or opening 11 is covered by film composite 30, is at the same time provided just off-center with fold 40, which rises upward from fold bottom 41 lying exactly in the plane of opening 11 of container 10. Fold 40 is shown slightly inclined, the reason for which is that it lies completely flat in the packed state, occupies little space in this way, and also offers no opportunity for gripping by the screw cap during the screwing on.

Figure 3:
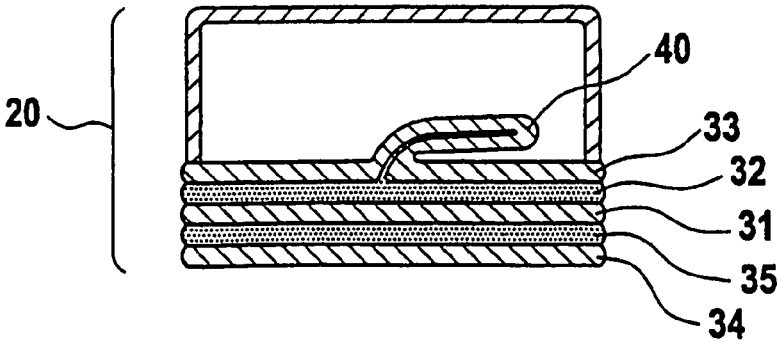
FIG. 3 is a diagrammatic section through a sealing disc with a sealing film of corresponding form of execution from FIG. 2.

FIG. 3 shows diagrammatically a complete sealing disc 20, of which the film composite 30 with its three film and two adhesive layers 31, 32, 33, 34 and 35 together with fold 40, forms the bottom-most part.

The upper portion may be a polyamide layer or another polymer.

Use is possible for all containers, glass, PET, PAC, PP, PVC. The sealing layer beneath the aluminum induction film layer 31 is adapted to any material of the container.

The end consumer is provided with an outstanding quality, a construction that can be opened easily by means of the projecting fold, which also opens reliably and does not tear.

The filler or packaging manufacturer is presented with the advantage that such a sealing film or such a sealing disc may be used particularly reliably without problems during the charging operation having to be anticipated.

The manufacturer of the sealing film is presented with the advantage that he longer has to carry out strip lamination, but is concerned exclusively with materials covering a whole area.

The fold 40 is not formed until the punching stage. A suitable tool of a punching tool is set so that the whole-area material arrives suitably folded.

What is claimed is:

1. A film composite for a container closure for use on a container with an opening bounded by a peripheral edge, wherein the film composite consists of a plurality of layers and between the upper-most layer and the layer beneath it there is arranged an adhesive layer at least over a joining surface, wherein only the upper-most layer of the film composite comprises an upwardly projecting fold, wherein said fold only in said upper-most layer is formed by a portion of the upper-most layer being laid double between a fold bottom and a fold tip, and wherein a contiguous portion of said adhesive layer extends within said laid double portion.

2. The film composite of claim 1, wherein the film composite includes a sealing layer, a middle layer, and a facing layer.

3. The film composite of claim 1, wherein the fold is arranged off-center.

4. The film composite of claim 3, wherein the fold divides the surface of the opening of the container into two areas, the smaller of which makes up between 40 percent and less than 50 percent of the surface.

5. The film composite of claim 1, wherein the fold includes a fold bottom which forms a straight line that passes diagonally through the entire area of the film composite zone arranged on the opening.

6. The film composite of claim 1, wherein the fold has a constant height from the fold bottom to the fold tip.

7. The film composite of claim 1, wherein the fold extends roughly 0.5 to 2 cm from the fold bottom to the fold tip.

8. The film composite of claim 7, wherein the fold extends roughly 1 to 1.5 cm from the fold bottom to the fold tip.

9. The film composite of claim 1 wherein said plurality of layers also includes a lower-most layer adapted to be in tight sealing engagement about the entire opening peripheral edge.

10. The film composite of claim 1, wherein the adhesive layer covers the whole area of the under side of the upper layer of the film composite.

11. The film composite of claim 1, wherein the film composite is slightly greater than the opening extends beyond the peripheral edge.

12. The film composite of claim 1 wherein the upper-most layer in the area of the fold is laid double starting from a fold bottom, extending to a fold tip and returning to a fold bottom.

13. A sealing disc for a container closure for use on a container with an opening bounded by a peripheral edge, comprising:

a plurality of layers including at least an upper layer and a layer therebelow, each layer extending at least to the peripheral edge of the opening; and an adhesive layer between the upper layer and the layer therebelow, the adhesive layer extending at least to the peripheral edge of the upper and lower layers;

an upwardly projecting fold disposed only in the upper layer and formed by a portion of the upper layer being laid double between a fold bottom and a fold tip;

the upper layer within the fold receiving a portion of said adhesive layer therein.

14. The sealing disc of claim 13 wherein the upper layer in the area of the engagement device is laid double starting from a fold bottom, extending to a fold tip and returning to a fold bottom.

15. The film composite of claim 13 wherein said plurality of layers also includes a lower-most layer below the other two layers and adapted to be in tight sealing engagement about the entire opening peripheral edge.

* * * * *